US005293446A

United States Patent [19]

Owens et al.

[11] Patent Number: 5,293,446

[45] Date of Patent: Mar. 8, 1994

[54] TWO STAGE THERMOSTATICALLY CONTROLLED ELECTRIC WATER HEATING TANK

[76] Inventors: George G. Owens, 1220 Highway 3033, West Monroe, La. 71292; Ernest D. Brinson, Rt. 1 Box 148, Portland, Ark. 71663

[21] Appl. No.: 705,746

[22] Filed: May 28, 1991

[51] Int. Cl.[5] ..... H05B 1/02; H05B 3/82; F24H 1/20

[52] U.S. Cl. ..... 392/449; 122/13.2; 126/362; 392/447; 392/455; 392/497; 392/500

[58] Field of Search ..... 219/449–461; 126/362, 361, 351; 122/13.1, 13.2; 392/444–447

[56] References Cited

U.S. PATENT DOCUMENTS

| | | | |
|---|---|---|---|
| 1,779,937 | 10/1930 | Holinger . | |
| 1,827,087 | 10/1931 | Hynes | 392/453 |
| 1,839,236 | 1/1932 | Lonergan | 392/453 |
| 1,986,636 | 1/1935 | Holinger . | |
| 2,038,476 | 4/1936 | Clark et al. | 392/454 |
| 2,104,848 | 1/1938 | Clark | 392/451 X |
| 4,282,421 | 8/1981 | Aadar . | |
| 4,474,139 | 10/1984 | Dobias . | |
| 4,506,140 | 3/1985 | Armstrong | 392/453 |
| 4,514,617 | 4/1985 | Amit . | |
| 4,578,565 | 3/1986 | Dawidowitch . | |

*Primary Examiner*—Anthony Bartis
*Attorney, Agent, or Firm*—John M. Harrison

[57] ABSTRACT

A two-stage electric water heater which utilizes a centrally located, vertically-oriented flue pipe and multiple heating elements extending through selected lengths of copper tubing positioned in the flue pipe to heat the water surrounding the flue pipe. In a preferred embodiment a two-stage thermostat operates to selectively energize less than the total number of heating elements at a high energy level in order to raise the water temperature quickly from room temperature to a desired level. A single-stage thermostat may then be used to maintain the water at this temperature during normal operation. In another preferred embodiment the copper tubes through which the heating elements extend are dimpled or crimped into contact with the heating elements to increase heat transfer.

20 Claims, 1 Drawing Sheet

TWO STAGE THERMOSTATICALLY CONTROLLED ELECTRIC WATER HEATING TANK

BACKGROUND OF THE INVENTION

1. Field of the Invention

This invention relates to hot water heaters and more particularly, to a two-stage electric hot water heater which is characterized by a tank having a vertically-oriented flue pipe in the center thereof and multiple heating elements encased in copper tubes extending through the flue pipe for heating water in the tank surrounding the flue pipe. In a first preferred embodiment a single-stage or two-stage thermostat is utilized to energize the heating elements, raise the water temperature to a specified level and maintain the water temperature at this level. In a second preferred embodiment a single-stage thermostat is provided in the circuit with a two-stage thermostat to maintain the water at a selected temperature. In the second embodiment the two-stage thermostat is wired in the circuit with tile heating elements to facilitate energizing of selected ones of the heating elements for quickly heating the water in the tank at a high energy level and subsequently switching maintenance of the water temperature to the single-stage thermostat when the water reaches a selected maintenance temperature. In a most preferred embodiment of the invention the heating elements are extended upwardly through selected ones of a cluster of copper tubes provided in the flue pipe and downwardly through other selected copper tubes. The ends of the heating elements are attached electrically to the two-stage thermostat and, in the case of the second embodiment of the invention, also to the single-stage thermostat, for operation. A resettable limit switch may also be provided in the circuit, as desired. Furthermore, the copper tubes which receive the heating elements may be dimpled or crimped to engage the heating elements in spaced relationship along the length of the heating elements, in order to increase heat transfer by conduction. Moreover, a quantity of junk copper may be stacked on top of the bends in the heating elements and the tubing cluster to provide a heat sink and further increase heat transfer to the water enclosed in the tank.

One of the problems which exists in electric water heaters is the high cost of heating water in the tank to a selected temperature and maintaining the water at this temperature for extended periods of time. This problem is exacerbated under circumstances where high demands are made on the water heater and the electric heating elements must be energized almost constantly to meet the demand. Various types of electric heating elements, including immersion-type elements and enclosed heating elements, have-been used in the past and with the development of the former, a serious problem of heat transfer reduction by scale and sediment is presented. This scaling and corrosion significantly reduces the efficiency of the elements and causes frequent burnouts.

It has been long known that maintaining water in a water heater tank at a high temperature is wasteful due to heat losses by conduction and convection, thereby requiring significant thickness of insulation in the tanks to minimize this loss. Maintaining the water at such a high temperature also promotes more rapid wear and tear, particularly on the heating elements, but also on the water heater tank itself. Accordingly, thermostatic controls are provided in these water heaters in order to control the water temperature in the tank and these controls provide an energy saving expedient for more efficient operation of electric water heaters.

An early "Water Heater" is detailed in U.S. Pat. No. 1,779,937, dated Oct. 28, 1930, to E. F. Holinger. The water heater includes a water holding tank having an opening in the top and an apparatus adapted to hold an electrically operated heating unit and distribute the heat therefrom. This apparatus is adapted for insertion through the opening as a unit and then attached to the tank for closing the opening. An "Electrical Heater for Tubular Boilers and Like Apparatus" is detailed in U.S. Pat. No. 1,986,636, dated Jan. 1, 1935, to E. F. Holinger. The Holinger device includes an electrical heating apparatus which can be safely inserted in the tubes of fire tube boilers and heat water in the boilers. The heater unit extends from either end of the boiler tube and the heating coil or electric resistor is contained in a perforated cylinder, which permits air circulation, but prevents the resistor from coming into contact with the boiler tube in case the latter sags or breaks. A "Dual Compartment Electric Water Heater" includes inner and outer water heating compartments in thermal communication with each other and arranged for free thermal communication of water therebetween. First and second electric elements are controlled by separate thermostats responsive to the water temperature in the tank. U.S. Pat. No. 4,474,139, dated Oct. 2, 1984, to John J. Dobias, details another "Water Heater Structure". The device includes an inner water tank into which cold water is passed and from which hot water is periodically withdrawn. It includes a jacket within the inner water tank constructed of material which absorbs and gives up heat rapidly, such that upon periodic withdrawal of hot water from the inner water tank, cold water entering the inner water tank is rapidly heated by the jacket, which has assumed the temperature of the hot water in the tank. A "Two-Stage Electric Water Heater" is detailed in U.S. Pat. No. 4,514,617, dated Apr. 30, 1985, to Haim Amit. The device includes a storage vessel and an elongated, thermostatically-controlled electric resistance heating element positioned in the vessel and surrounded by an elongated metal tube having a closed outer end attached to the wall of the vessel. The metal tube has an open inner end positioned at a higher level in the vessel and terminates short of the top of the vessel. The heater water outlet extends from the outer end of the tube to the outside of the vessel. An elongated, tubular, thermally-insulating body concentrically surrounds a major part of the length of the tube and is spaced from the tube to form a convective water flow passage communicating with the interior of the vessel near the inner and outer ends of the tube. During non-consumption, water flows upwardly through the water flow passage and is heated to a medium temperature by heat transfer from the metal tube, for storage in the vessel. During consumption, the stored water flow comes from the vessel end of the tube through the open end thereof and is heated to a high temperature by direct contact with the electric heater prior to discharge through the outlet for consumption. A "Combined Electric Heating and Water Inlet/Outlet Assembly for Water Heating Tanks" is detailed in U.S. Pat. No. 4,578,565, dated Mar. 25, 1986, to S. Dawidowwitch. The assembly is designed for installation in the bottom opening of a domestic water heater tank and includes a plastic mounting flange designed to cover the opening and a plastic, open-top, cylindrical sleeve extending upwardly therefrom and adapted to project into the tank through the opening. An electric immersion heating element is removably carried by the flange and projects into the sleeve and integrally-formed water inlet and outlet tubes extend along the outer generatixes of the sleeve. A second plastic, closed-top, cylindrical unit is received on top of the sleeve to form an extension thereof. An integral tubular section along the outer surface of the cylindrical members forms an extension of the outlet conduit and the closed top of the cylindrical member has an integral, upwardly-extending riser tube forming an outlet for water heated by the heating element. A series of integrally formed pairs of parallel, plastic tube lengths fit one on top of the other and on top of the tubular outlet and riser tube section to form extensions thereof up to the top wall of the tank. A valved opening is provided in the cylindrical member for introducing water from the tank and permitting termination of the water flow into the cylindrical member for replacing the heating element without emptying the whole tank.

It is an object of this invention to provide a two-stage electric hot water heater and control system which includes an elongated flue conduit located in a water tank and electric heating elements provided in elongated tubes located in the flue pipe for heating the tubes, flue conduit and the water surrounding the flue pipe to a selected temperature.

Another object of this invention is to provide an electric water heater provided with a two-stage thermostat and a single-stage thermostat and further including a tank fitted with an internal, vertically-oriented flue provided with a cluster of copper tubes and heating elements provided in selected ones of the copper tubes, which heating elements are wired to the two-stage and single-stage thermostats, wherein certain ones of the heating elements can be selectively energized to rapidly raise the water temperature in the tank and surrounding the flue pipe to a selected temperature and all of the heating elements may then be energized at a lower energy level to maintain the water at this selected temperature.

A still further object of this invention is to provide a new and improved electric hot water heater which is characterized by a cylindrical water-containing tank, a vertically-oriented flue pipe extending through the center of the tank and containing multiple, tightly clustered copper tubes, selected ones of which tubes contain electric heating elements, and two-stage and single-stage thermostats provided in series electrical connection with the heating elements, to facilitate selectively energizing certain ones of the heating elements by operation of the two-stage thermostat to rapidly heat water contained in the tank and surrounding the flue pipe to a selected temperature at a high energy level and switching the water temperature control function to the single-stage thermostat for energizing all electric heating elements at a lower energy level and maintaining water at this selected temperature.

Yet another object of this invention is to provide a two-stage electric hot water heater which is characterized by a cylindrical tank for containing water, a vertically-oriented flue pipe extending vertically through the center of the tank and containing multiple lengths of clustered copper tubing, wherein heating elements are extended upwardly through selected ones of the copper tubing and back downwardly through other selected ones of the copper tubing and still other lengths of the copper tubing serve as heat transfer filler pipe, and further including junk copper placed on top of the copper tubing and heating elements in the flue pipe as a heat sink, wherein a two-stage thermostat and a single-stage thermostat are attached in series with the heating elements to facilitate initially energizing selected ones of the heating elements at a high energy level to heat water contained in the tank to a selected temperature by operation of the two-stage thermostat and thereafter maintaining the water in the tank at this selected temperature at a lower energy level by heating all of the heating elements using the single-stage thermostat.

A still further object of this invention is to provide a new and improved two-stage electric hot water heater which utilizes a two-stage thermostat and a single-stage thermostat connected in series to electric heating elements located in copper tubes vertically oriented in the flue pipe of a hot water heater, with the copper tubes crimped or dimpled for contact with the enclosed heating elements to initially heat air in the tubes and then the tubes themselves, the flue pipe and water in the tank to a selected temperature by energizing selected ones of the heating elements through operation of the two-stage thermostat and subsequently maintaining the water at this temperature by operation of the single-stage thermostat.

SUMMARY OF THE INVENTION

These and other objects of the invention are provided in a two-stage electric water heater which utilizes a conventional gas hot water heater tank provided with a conventional, upward-standing, vertically-oriented flue pipe and a two-stage thermostat and single-stage thermostat connected in series to electric heating elements extending through selected lengths of a cluster of copper tubing which is vertically-oriented in the flue pipe, to initially heat water in the tank and surrounding the flue pipe to a selected temperature by operation of the two-stage thermostat which energizes selected ones of the heating elements at a high energy level and subsequently maintaining the water in the tank at this desired temperature by opera-Lion of the single-stage thermostat to energize all of the heating elements at a lower energy level.

BRIEF DESCRIPTION OF THE DRAWING

The invention will be better understood by reference to the accompanying drawing, wherein.

DESCRIPTION OF THE PREFERRED EMBODIMENTS

Figure 1:
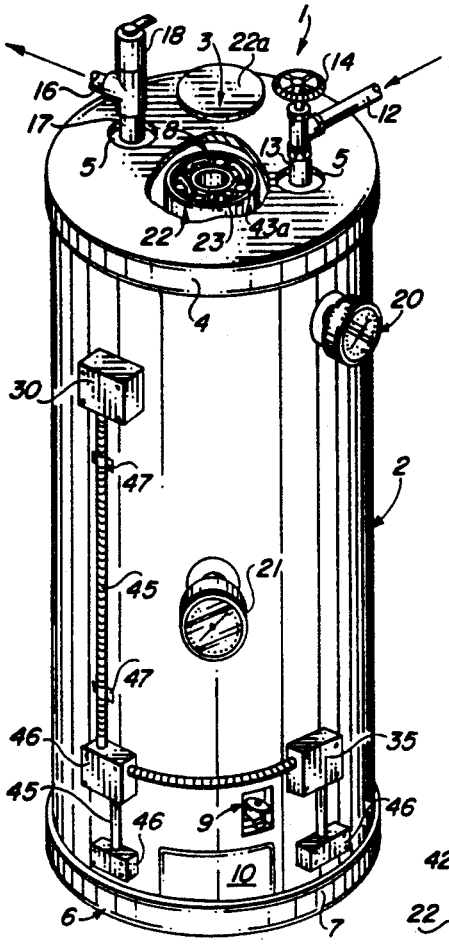
FIG. 1 is a perspective view of a preferred embodiment of the two-stage electric hot water heater of this invention.

Referring initially to FIG. 1 of the drawings, in a preferred embodiment the two-stage electric hot water heater of this invention is characterized by a cylindrically-shaped water tank 1, having a steel jacket 2 terminated by a top plate 3, having a top plate flange 4. A bottom plate 6, provided with a bottom plate flange 7, terminates the bottom end of the water tank 1 and a pair of top plate openings 5 are provided in the top plate 3 in spaced relationship to accommodate an inlet line nipple 13 and an outlet line nipple 17, respectively, both of which communicate with the hollow interior 8 of the water tank 1. An inlet line valve 14 is attached to the inlet line nipple 13 and receives a cold water inlet line 12 for receiving cold water into the interior 8 of the water tank 1. Furthermore, a safety valve 18 is mounted on the outlet line nipple 17 and receives a hot water outlet line 16 for dispensing hot water from the interior 8 of the water tank 1. A discharge faucet 9 is provided at the lower end of the water tank 1 to facilitate draining the interior 8 of the water tank 1 on demand and a pilot plate 10 is removably seated on the jacket 2 of the water tank 1, since the water tank 1 may be designed for conventional gas firing, according to the knowledge of those skilled in the art. A top temperature gauge 20 is mounted on the jacket 2 of the water tank 1 and has a probe (not illustrated) which extends through the jacket 2 and insulation (not illustrated) located on the inside of the jacket 2, into the interior 8 of the water tank 1 to measure the temperature of the water at the upper end of the water tank 1. A bottom temperature gauge 21 extends from the jacket 2 of the lower portion of the water tank 1 and also includes a probe (not illustrated) which extends into the interior 8 of the water tank 1 for measuring the temperature at this point. A sleeve conduit or flue pipe 22 extends vertically through the approximate center of the water tank 1 and projects through the top plate 3, and normally serves as a conduit for exhaust gases in a gas fired water heater. However, for the purposes of the two-stage electric hot water heater of this invention the flue pipe 22 is fitted with a cluster of heating element tubing or heat transfers conduits 42.

Figure 3:
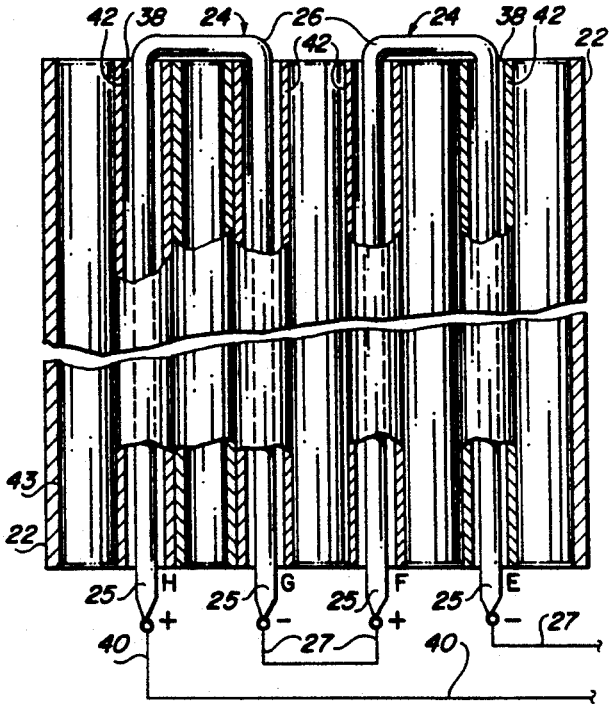
FIG. 3 is a sectional view taken along 3—3 of the two-stage electric hot water heater illustrated in FIG. 2.
Figure 2:
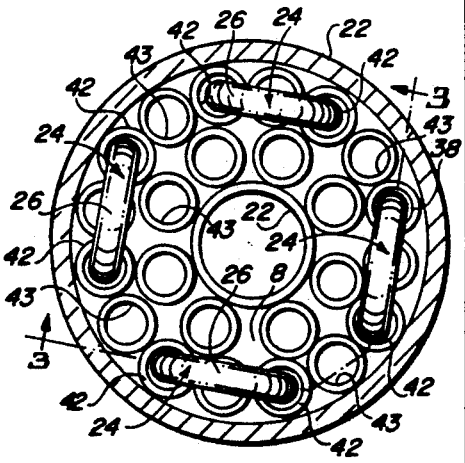
FIG. 2 is a top plan view of the flue pipe of the two-stage electric hot water heater illustrated in FIG. 1 with the top plate removed to illustrate the heating element, fill tubing and central filler tube.

Referring now to FIGS. 1-3 of the drawing, in a most preferred embodiment of the invention the element legs 25 of multiple electric heating elements 24 are located in spaced lengths of the heating element tubing 42, wherein the element legs 25 are connected at the top of the flue pipe 22 by an element bend 26, as illustrated in FIG. 2. In this embodiment of the invention the remaining, hollow fill tubing 43 in the tubing cluster serves to space the heating element tubing 42 and create spaces both in the heating element tubing 42 and the fill tubing 43 and between the heating element tubing 42 and fill tubing 43, in the flue pipe 22. As illustrated in FIG. 3, the tubing margin 38 is constricted to within about one-eighth of an inch of the element legs 25, to facilitate heating the air inside the heating element tubing 42 to a sufficiently high temperature, as hereinafter further described. In another preferred embodiment of the invention the single and larger fill tubing 43A located in the center of the flue pipe 22 is inserted after the remaining heating element tubing 42 and fill tubing 43 cluster have been inserted, in order to tighten the heating element tubing 42 and fill tubing 43 against each other inside the flue pipe 22 to facilitate efficient conductive heat transfer characteristics.

Figure 4:
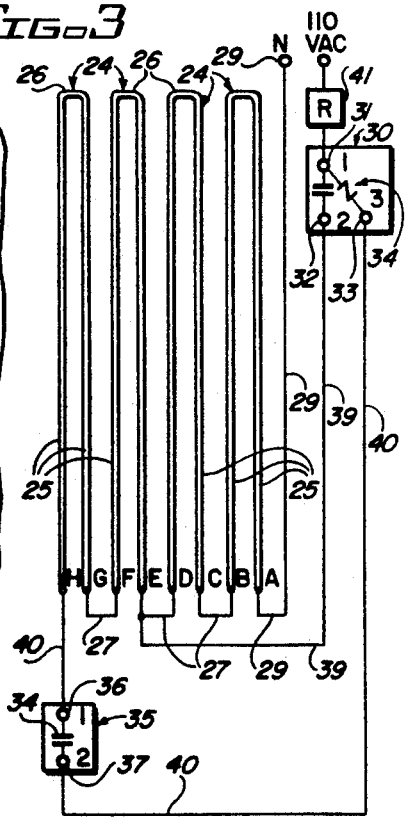
FIG. 4 is a schematic diagram of a preferred wiring system for operating the two-stage electric hot water heater illustrated in FIGS. 1 and 2 using a two-stage thermostat and a single-stage thermostat.

Accordingly, referring now to FIGS. 1-4 of the drawings and particularly to FIG. 4, the element legs 25 of the respective electric heating elements 24 project downwardly from corresponding heating element tubing 42 and are connected in series by a neutral lead 29, leg connectors 27 and an alternate hot lead 40, in a first electrical sequence. In a most preferred wiring sequence of the two-stage electric hot water heater, the neutral lead 29 is attached to the element leg 25 designated by the letter "A", the alternate hot lead 40 extends from a two-stage thermostat 30 to a single-stage thermostat 35 and is attached to the element leg 25 designated by the letter "H" and the remaining element legs 25, designated by the letters "B", "C", "D", "E", "F" and "G" are attached to each other, respectively, in series by means of leg connectors 27. In another electrical sequence one end of a hot lead 39 is connected to the leg connector 27 which connects the element legs 25 designated by the letters "D" and "E", while the opposite end of the hot lead 39 is attached to the two-stage terminal 32 of the two-stage thermostat 30, which is mounted on the top area of the jacket 2 of the water tank 1, as illustrated in FIG. 1. The two-stage thermostat 30 is operated according to the temperature of the water located in the water tank 1, measured near the top of the heater tank 1 at the level of the top temperature gauge 20. A two-stage terminal 31 is disposed in the two-stage thermostat 30 opposite the two-stage terminal 32 and nay be connected to the two-stage terminal 32 by a thermostat switch 34, depending upon the temperature of the water in the upper end of the water tank 1, as hereinafter further described. The two-stage terminal 31 is connected to a resettable limit switch 41, which is in turn plugged directly into a 110-volt source of electric current. A third two-stage terminal 33 is provided in the two-stage thermostat 30 and is connected to the alternate hot lead 40 that extends to the single-stage terminal 37 of the single-stage thermostat 35, which is mounted on the lower end of the heater tank 1, as illustrated in FIG. 1. The alternate hot lead 40 continues from a second single-stage terminal 36 located in the single-stage thermostat 35 and terminates at the element leg 25 designated by the letter "H", as heretofore described. A thermostat switch 34 is also provided in the single-stage thermostat 35 to facilitate "on" and "off" operation of the single-stage thermostat 35, according to the temperature of the water located in the water tank 1 at the level of the bottom temperature gauge 21. Accordingly, the single-stage thermostat 35 switches from the "on" to the "off" and vice-versa position, depending upon the temperature of the water at the bottom temperature gauge 21 level, as hereinafter described.

Figure 5:
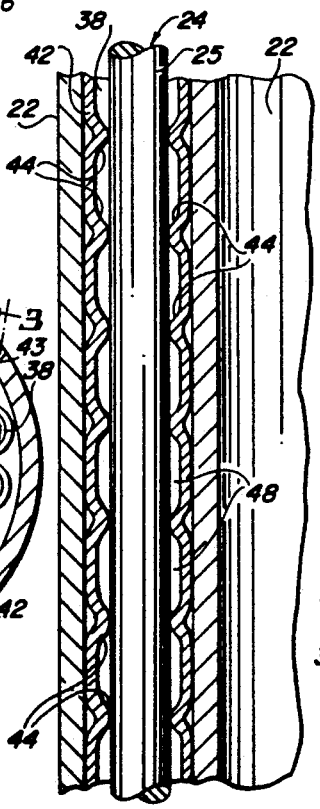
FIG. 5 is an enlarged sectional view of a preferred heating element and encapsulating copper tubing configuration, wherein the copper tubing is dimpled or crimped to increase heat conduction from the heating element through the copper tubing and the flue pipe.

Referring now to FIG. 5 of the drawing, in another preferred embodiment of the invention the heating element tubing 42 are provided with multiple, spaced tubing dimples 44 which are crimped into the heating element tubing 42 and touch the corresponding element leg 25 of the electric heating elements 24 to increase heat transfer by conduction through the heating element tubing 42. This procedure also serves to isolate multiple air pockets 48 located between the respective tubing dimples 44 and facilitates more efficient heat transfer as the air in the air pockets 48 heats to the desired temperature and helps to maintain a constant flow of heat from each of the element legs 25 through the heating element tubing 42 and the flue pipe 22, into the water located in the interior 8 of the water tank 1. It is also understood that the element legs 25 may be offset in a zigzag pattern in the heating element tubing 42 to achieve the same result.

Referring again to FIG. 1 of the drawings, in still another preferred embodiment of the invention the two-stage thermostat 30 is connected to the wiring boxes 46 and to the single-stage thermostat 35 by means of wiring conduit 45 which is secured to the jacket 2 of the water tank 1 by means of spaced brackets 47. An additional wiring box 46 is connected to the single-stage thermostat 35. The wiring boxes 46 serve to receive the respective leg connectors 27, neutral lead 29, hot lead 39 and alternate hot lead 40 and facilitate wiring of the two-stage thermostat 30 and single-stage thermostat 35 into the circuit illustrated in FIG. 4 with the element legs 25 of the heating elements 24.

As further illustrated in FIG. 1, in yet another preferred embodiment of the electric invention a quantity of junk copper 23 is placed in random relationship in the top end of the flue pipe 22 resting on the element bends 26 and the ends of the heating element tubing 42 and fill tubing 43. The junk copper 23 serves as a heat sink when a lid or cap **22*a* is placed over the upper end of the flue pipe 22, to receive the superheated air from the constricted ends of the heating element tubing 42 at the tubing margins 38 and store additional heat and more effectively transfer heat from the electric heating elements 24 and the interior of the flue pipe 22 to the water surrounding the flue pipe 22**.

Referring again to the drawing, it will be appreciated by those skilled in the art that various wiring configurations can be effected in the two-stage electric hot water heater using either the two-stage thermostat 30 or the single-stage thermostat 35. For example, the single-stage thermostat 35 may be eliminated and the 2-stage thermostat 30 operated to apply current selectively to the alternate hot lead 40 and hot lead 39 and heat each of the element legs 25 designated "A"-"H", or only the element legs 25 designated A-E, respectively, of the heating elements 24. Similarly, the single-stage thermostat 35 may be used to effect the electric element legs 25 designated A-H heating function, wherein the two-stage thermostat 30 is eliminated from the series circuit and the alternate hot lead 40 is attached directly to the resettable temperature timer switch 41 and the 110-volt current source. However, in a most preferred embodiment of the invention the two-stage electric hot heater is operated by using both the two-stage thermostat 30 and the single-stage thermostat 35 as hereinafter described.

In operation, and referring again to the drawing, in the embodiment of the invention wherein the single-stage thermostat 35 is eliminated in the circuit illustrated in FIG. 4 and the alternate hot lead 40 extends directly from the two-stage thermostat terminal 33 of the two stage thermostat 30 to the element leg 25 designated by the letter "H", water is initially introduced into the water tank 1 through the cold water inlet line 12 by opening the inlet line valve 14, in conventional fashion. The water enclosed in the interior 8 of the water tank 1 is then initially heated by operation of the two-stage thermostat 30, wherein the thermostat switch 34 bridges the two-stage terminal 31 and two-stage terminal 32 to facilitate a flow of electricity at a high energy level through the hot lead 39 and the element legs 25 designated by the letters "A, B, C and D" of the respective corresponding electric heating elements 24, which element legs 25 are connected by leg connectors 27. The current continues to flow through the hot lead 39 and neutral lead 29 and supplies approximately 760 watts by way of example, through the leg connectors 27 and element legs 25, to rapidly heat the enclosed water to a selected temperature. After this temperature is reached, the thermostat switch 34 automatically resets to bridge the two-stage terminal 31 and the two-stage terminal 33, whereby electricity is now caused to flow through the alternate hot lead 40 to the element leg 25 designated by the letter "H" in FIG. 4. The two-stage thermostat 30 then operates to maintain the selected temperature by energizing all of the element legs 25 by the respective electric heating elements 24 and maintaining a wattage of approximately 335 watts, by way of example, through the element legs 25, which represents a great savings in electrical costs while maintaining the water at a selected temperature in the water tank 1. Under circumstances where the water level is drastically lowered in the water tank 1 in a high demand situation, the two-stage thermostat 30 operates to again change the thermostat switch 34 and bridge the two-stage terminal 31 and two-stage terminal 32, to apply the electric 760 watts to the respective element legs 25 of the heating elements 24 and rapidly raise the temperature of the newly supplied incoming cold water to the desired maintenance temperature. This procedure continues while realizing a considerable savings through the difference between the maintenance wattage (335) applied to the electric heating elements 24 and the surge wattage (760) applied when fresh, cold water is introduced into the water tank 1.

In a most preferred embodiment of the invention, under circumstances where the single-stage thermostat 35 is provided in the alternate hot lead 40, the single-stage thermostat 35 operates to maintain the water temperature in the water tank at the desired maintenance temperature instead of the two-stage thermostat 30. Accordingly, in this embodiment, when cold water is first introduced into the water tank 1 as described above, water is rapidly heated to a desired maintenance temperature by operation of the two-stage thermostat 30 in the manner described above, utilizing current flow through the hot lead 39 and into the element legs 25 designated by the letters "A, B, C and D" of the corresponding electric heating elements 24, as illustrated in FIG. 4. When this maintenance temperature is effected, the thermostat switch 34 automatically operates to bridge the two-stage terminal 31 and two-stage terminal 33 of the two-stage thermostat 30 and allow current to flow through the alternate hot lead 40 and the single-stage thermostat 35, which single-stage thermostat 35 then operates to control the temperature of the water in the water tank 1. Any high demand for hot water on the water tank 1 then again lowers the hot water level, cold water is introduced into the water tank 1 and the thermostat switch 34 in the two-stage thermostat 30 again operates to override the single-stage thermostat 35 by causing current to flow from the two-stage terminal 31 through the two-stage terminal 32 and the hot lead 39 to energize the element legs 25 of the electric heating elements 24 designated by the letters "A, B, C and D".

It will be appreciated by those skilled in the art that the two-stage electric hot water heater of this invention characterized by considerable savings over conventional electric hot water heaters, since the initial heating operation brings the water temperature up to a maintenance temperature rapidly and efficiently and the maintenance of this temperature is effected at approximately half the surge wattage rate, for great efficiency and economy. Furthermore, since the electric elements 24 are enclosed inside the respective heating element tubing 42 and flue pipe 22, the element legs 25 do not come into direct contact with the water in the water tank 1 and this design eliminates the corrosive aspects of immersion-type elements and promotes safety. Moreover, under circumstances where the water supply is interrupted, the electric water tank 1 is not filled and the heating element 24 are energized either in high wattage or low wattage mode, there is no extensive heating of the water tank 1 heating element tubing 42 or flue pipe 22. Under these circumstances, the resettable limit switch 1 will operate to terminate electricity to the electric heating elements 24. Another advantage of the two-stage electric hot water heater of this invention is the ease and minimal cost of replacing the various parts, including the electric heating elements 24, two-stage thermostat 30 and single-stage thermostat 35, which thermostats are located on the outside of the water tank 1 for easy access. A still further advantage in using the two-stage electric hot water heater of this invention is the capacity for converting substantially any conventional gas fired water heater to an electric water heater of high efficiency.

It will be further appreciated by those skilled in the art that the two-stage electric hot water heater of this invention can be operated on both 120 volts and 240 volts, as well as any other selected voltage, depending upon the chosen wiring combination through the neutral lead 29 and the two stage thermostat 30, according to the knowledge of those skilled in the art. Furthermore, although the two-stage thermostat 30, single-stage thermostat 35, wiring boxes 46, wiring conduit 45 and optional top temperature gauge 20 and bottom temperature gauge 21 are illustrated external of the jacket 2 of the water tank 1, it is understood that the jacket 2 may be designed to fit over all or some of these components, as desired.

While the preferred embodiments of the invention have been described above, it will be recognized and understood that various modification nay be made therein and the appended claims are intended to cover all such modifications which may fall within the spirit and scope of the invention.

Having described my invention with the particularity set forth above, what is claimed is:

1. A two-stage electric hot water heater comprising a tank for receiving cold water and dispensing hot water, a vertical sleeve conduit provided in said tank, a plurality of vertically disposed heat transfer conduits provided in said sleeve conduit, at least one electric heating element provided in at least one of said heat transfer conduits and thermostat means electrically connected to said at least one heating element for causing electricity to flow through said at least one heating element and heating said heat transfer conduits, said sleeve conduit and the water in said tank.

2. The two-stage electric hot water heater of claim 1 wherein a plurality of electric heating elements are provided, disposed each in selected ones of said heat transfer conduits.

3. The two-stage electric hot water heater of claim 2 wherein said heating elements extend upwardly from the bottom ends of first selected ones of said heat transfer conduits through tops of said first selected ones of said heat transfer conduits and then downwardly through the tops of second selected ones of said heat transfer conduits, to exit the bottoms of said second selected ones of said heat transfer conduits.

4. The two-stage electric hot water heater of claim 3 wherein said thermostat means comprises a two-stage thermostat connected to all of said heating elements in a first electrical configuration and to selected ones of said heating elements in a second electrical configuration, and a single-stage thermostat connected to all of said heating elements.

5. The two-stage electric hot water heater of claim 4 wherein said first and second selected ones of said heat transfer conduits are inwardly dimpled into engagement with said heating elements for increasing the heat transfer through said heat transfer conduits.

6. The two-stage electric hot water heater of claim 5 further comprising a plurality of junk copper provided on the top of said heat transfer conduits in said sleeve conduit and a cap provided on said sleeve conduit for enclosing said copper pieces and defining a heat sink in said sleeve conduit.

7. The two-stage electric hot water heater of claim 1 wherein said thermostat means comprises a single-stage thermostat.

8. The two stage electric hot water heater of claim 1 wherein a plurality of electric heating elements are provided, each disposed in selected ones of said heat transfer conduits and said thermostat means comprises a single-stage thermostat.

9. The two stage electric hot water heater of claim 1 wherein said at least one of said heat transfer conduits is inwardly dimpled to engage with said heating element for increasing the heat transfer through said at least one heat transfer conduits.

10. The two stage electric water heater of claim 9 wherein a plurality of electric heating elements are provided, each disposed in selected ones of said heat transfer conduits and said thermostat means comprises a single-stage thermostat.

11. The two-stage electric hot water heater of claim 1 further comprising a plurality of junk copper provided on the top of said heat transfer conduits in said sleeve conduit and a cap provided on said sleeve conduit for enclosing said metal pieces and defining a heat sink in said sleeve conduit.

12. The two-stage electric hot water heater of claim 10 wherein a plurality of electric heating elements are provided, each disposed in selected ones of said heat transfer conduits.

13. The two-stage electric hot water heater of claim 12 wherein said thermostat means comprises a single-stage thermostat.

14. The two-stage electric hot water heater of claim 12 wherein said heating elements extend upwardly from the bottom ends of first selected ones of said heat transfer conduits through the tops of said first selected ones of said heat transfer conduits and then extend downwardly through the tops of second selected ones of said heat transfer conduits, to exit the bottoms of said second selected ones of said heat transfer conduits.

15. The two-stage electric hot water heater of claim 14 wherein said first and second selected ones of said heat transfer conduits are inwardly dimpled into engagement with said heating elements for increasing the heat transfer through said heat transfer conduits.

16. The two-stage electric hot water heater of claim 14 wherein said thermostat means comprises a two-stage thermostat connected to all of said heating elements in a first electrical configuration and to selected ones of said heating elements in a second electrical configuration and a single-stage thermostat connected to all of said heating elements.

17. The two-stage electric hot water heater of claim 13 wherein said thermostat means comprises a two-stage thermostat connected to all of said heating elements in a first electrical configuration and to selected ones of said heating elements in a second electrical configuration and a single-stage thermostat connected to all of said heating elements, said first and second selected ones of said heat transfer conduits are inwardly crimped into engagement with said heating element for increasing the heat transfer through said heat transfer conduits and wherein said metal pieces include a plurality of junk copper provided on the top of said heat transfer conduits in said sleeve conduit for defining a heat sink in said heat transfer conduits.

18. A two-stage electric hot water heater comprising a cylindrical tank adapted for receiving cold water and dispensing hot water; a flue vertically oriented in said tank and surrounded by water in said tank; a plurality of vertically-disposed copper tubes deployed in said flue in a substantially tight cluster; a plurality of generally U-shaped electric heating elements, each having one leg disposed in a separate one of selected ones of said copper tubes, with the unconnected ends of said heating elements projecting from the bottoms of said selected ones of said copper tubes and the connected top ends of said heating elements bridging said selected ones of said copper tubes, respectively; a two-stage thermostat connected in series to selected ones of said heating elements in a first electrical configuration and to all of said heating elements in a second electrical configuration; and a single-stage thermostat connected to all of said heating elements, whereby electric current is caused to flow through selected ones of said heating elements at a first selected energy level in said first electrical configuration to rapidly heat the water in said tank to a preselected temperature responsive to operation of said two-stage thermostat and through all of said heating elements at a second selected energy level in said second electrical configuration, responsive to operation of said single-stage thermostat.

19. The two-stage electric hot water heater of claim 18 further comprising a plurality of junk copper provided on the top of said heat transfer conduits in said flue and a cap provided on said flue for enclosing said copper pieces and defining a heat sink in the top of said flue.

20. The two-stage electric hot water heater of claim 19 wherein said selected ones of said copper tubes are inwardly crimped into engagement with said heating elements for increasing the heat transfer through said selected ones of said copper tubes.

* * * * *